US006311971B1

(12) United States Patent
Greer et al.

(10) Patent No.: US 6,311,971 B1
(45) Date of Patent: Nov. 6, 2001

(54) STACKER CONTROLLING CURL

(75) Inventors: David Emerson Greer; William Joseph Thornhill, both of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/611,126

(22) Filed: Jul. 6, 2000

(51) Int. Cl.[7] ..... B65H 31/26

(52) U.S. Cl. ..... 271/220; 271/207; 270/58.08; 270/58.11

(58) Field of Search ..... 270/58.07, 58.08, 270/58.11, 58.12; 271/220, 221, 222, 207

(56) References Cited

U.S. PATENT DOCUMENTS

| | | | | |
|---|---|---|---|---|
| 3,847,388 | * | 11/1974 | Lynch | 271/220 X |
| 4,061,331 | | 12/1977 | Habich . | |
| 4,625,956 | * | 12/1986 | Marass et al. | 271/183 |
| 4,687,193 | * | 8/1987 | Scarabino et al. | 271/217 X |
| 4,898,374 | * | 2/1990 | Vermaat | 271/223 X |
| 5,120,046 | * | 6/1992 | Mandel et al. | 271/220 |
| 5,415,390 | | 5/1995 | Guerrero . | |
| 5,745,141 | | 4/1998 | Miyawaki . | |
| 5,791,644 | | 8/1998 | Regimbal et al. . | |
| 6,142,466 | * | 11/2000 | Dickhoff | 271/220 |
| 6,209,864 | * | 4/2001 | Taniguchi et al. | 271/220 |

FOREIGN PATENT DOCUMENTS

408123116A * 5/1996 (JP) .

* cited by examiner

*Primary Examiner*—Christopher P. Ellis
*Assistant Examiner*—Patrick Mackey
(74) *Attorney, Agent, or Firm*—John A. Brady

(57) ABSTRACT

A printer (1) exits paper sheet(s) onto a table (6) where they are stacked and bound by stapler (15). Curl in the sheets is controlled by eccentric guide (9), which has a high section (9*a*) which moves over the sheet as they are moved across the table (by pusher 7*a*). The sheets are guided under clamp arm (11) by encountering the angled side (11*a*) of clamp arm (11). In the embodiment the sheets are first moved backward against reference wall 23 (by pusher 7*b*), and they are moved (by pusher 7*a*) under clamp arm 11 until encountering reference wall 13. The next sheet drops off of table 6 while a low section (9*b*) of the guide is position toward the next exiting sheet. In this manner a group of sheets is formed into a regular stack and are bound by the stapler.

16 Claims, 1 Drawing Sheet

STACKER CONTROLLING CURL

TECHNICAL FIELD

This invention relates to the stacking of sheets so that they can be stapled or otherwise bound, an operation generally referred to as "finishing."

BACKGROUND OF THE INVENTION

Paper exiting a printer tends to curl. This is particularly true for paper exiting an electrophotographic printer having a fusing process to fix toner, as is widely practiced. The wetter the paper is before printing, the more curl occurs.

It is desirable to have the capability of the printer exiting the paper into a finisher, which stacks and binds the paper with a staple or other binder technique, such as stitching. In order to staple or bind such a stack of paper, the stack must be loaded into a throat of a stapler or other binding apparatus, which becomes difficult when the paper is curled. This invention flattens the curl in the vicinity of such a throat and presses the paper into a uniform stack.

U.S. Pat. No. 5,415,390 to Guerrero has a stationary member in a stacker to accommodate curl. This invention employs a movable member in association with a guide on a clamp.

DISCLOSURE OF THE INVENTION

In accordance with this invention individual sheets exiting a printer or other imaging device are moved toward an eccentric member, which rotates in coordination with the element moving the sheet. The eccentric member has a high surface and a low surface. As the sheet reaches the eccentric member the high surface is located to contact the paper and pushes it downward. The sheet is then moved into a clamp, the facing surface of which is at an acute angle, which guides the paper downward. Preferably the sheet is moved against a first reference surface before it is moved perpendicular to the first reference surface into the clamp to encounter a second reference surface. The clamp is resiliently mounted lightly so as to allow an entering sheet to push the clamp open. Upon entering the clamp, the sheet encounters the second reference surface. Alternatively, the clamped paper may be pushed perpendicular to the clamp surface against a reference surface.

Both alternatives form a uniform stack of previous and subsequent sheets, which are moved in the same manner. After the movement of a sheet to the clamp member, the eccentric member rotates so that its low surface is toward the paper exit. The low surface does not extend to encounter sheets exiting the printer, so the next sheet can fall to be moved against the clamp and the reference surface as described.

BRIEF DESCRIPTION OF THE DRAWINGS

The details of this invention will be described in connection with the accompanying drawings, in which.

DESCRIPTION OF THE PREFERRED EMBODIMENTS

Figure 1:
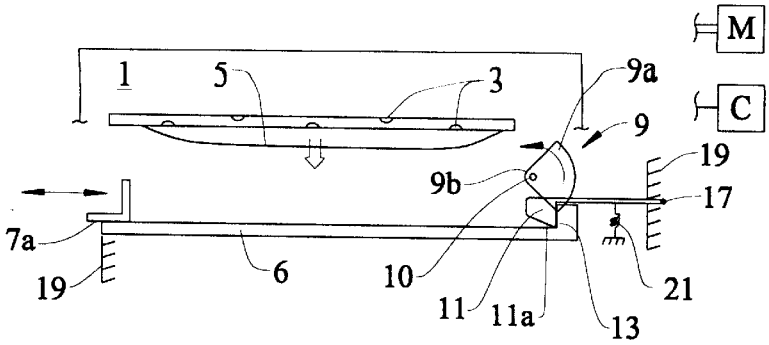
FIG. 1 is a front view showing paper dropping out of the printer.

With reference to FIG. 1, a printer 1 or other imaging device is suggested illustratively having output rollers 3 that eject printed sheets. A sheet of paper or other media 5 is shown having just been moved out of printer 1 by output rollers 3 by providing sufficient momentum to paper 5 for it to leave printer 1, as is standard.

Figure 2:
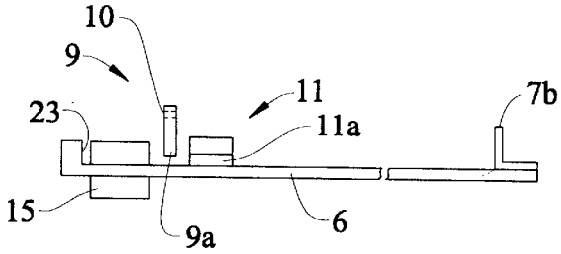
FIG. 2 is a side view from the left showing the eccentric curl guide and the front of the clamp, as well as a stapler shown illustratively.

Paper 5 is shown in its normal action of falling under the force of gravity to rest above a generally flat table 6. Shown to the left in FIG. 1 is a pushing member 7*a*, which will be moved to the right to move the sheet 5. A similar pushing member 7*b* is shown in FIG. 2 to move paper to the left in FIG. 2, which is inward away from the viewer in FIG. 1 and FIGS. 2 through 5.

It should be understood with respect to this invention that pushing members 7*a* and 7*b* are simply one general illustration of mechanism to move the individual sheets. Alternatively, the sheets could be moved by members which contact the surface of the sheets with an attachment such as by friction or vacuum, rather than contacting the ends as do pushing members 7*a* and 7*b*. Any structure which moves the sheets as to be described is clearly an alternative with respect to this invention since how the sheet is moved is incidental of the essential functioning of this invention.

Sheet 5 is shown curled on each side as is typical. At the right in FIG. 1 is shown eccentric guide 9 mounted for rotation on shaft 10 having a high section 9*a* and a low section 9*b*, with the low section 9*b* facing paper 5 in FIG. 1. Also shown are a clamp arm 11, and a side reference wall 13. A stapler 15, shown illustratively in FIG. 2, is omitted from FIGS. 1 and 3 through 5 for clarity.

Clamp arm 11 is pivoted on pin 17 to a frame structure 19, and lightly biased downward by spring 21 or other resilient element. Table 6 is similarly supported on frame 19. Also shown illustratively in FIG. 1 is a motor M and electronic data processor C (commonly termed a computer). Overall control is by computer C, as is standard for electronic controls. Motor M is linked by transmission members (not shown) to rotate eccentric guide 9 around shaft 10. Motor M may be similarly linked to move pushing members 7*a* and 7*b*. When pushing members 7*a* and 7*b* and guide 9 are moved from the same source, such as motor M, their movement may be directly coordinated. As is also standard, timing controls in the software program of computer C can dictate the movement of the various parts of this invention if they have separate drive sources.

With reference to FIG. 2, eccentric guide 9 is shown with high section 9*a* nearest table 6. No sheet 5 is shown so as not to obstruct the view of the elements shown. The face of high section 9*a* may be smooth, as it should not obstruct the movement of sheet 5 into clamp arm 11 and against reference wall 13 (FIG. 1). Reference wall 23 is perpendicular to reference wall 13. The high section 9*a* of guide 9 is spaced from table 6 at its lowest point as shown to leave room for a stack of sheets 5 to be formed.

As shown is FIG. 1, lower front side 11*a* of clamp arm 11 has an acute angle so as to receive sheet 5 at an angle which directs sheet 5 downward to push under clamp arm 11 by overcoming the force of resilient member 21. Angled side 11 a of arm 11 faces away from reference wall 13 and toward pusher 7*a*. Each sheet 5 is moved under clamp arm 11 until stopped against reference wall 13.

In operation, each sheet 5 exits printer 1 as shown in FIG. 1 with the low section 9*b* of guide 9 facing the paper and therefore guide 9 is not obstructing sheet 5 from falling onto table 6.

Pusher 7*b* (FIG. 2) then moves to push sheet 5 rearward toward reference wall 23 until sheet 5 is in full contact with reference wall 23.

Figure 3:
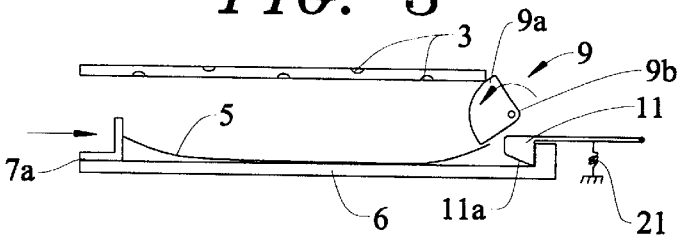
FIG. 3 is similar to FIG.1 showing the system at a subsequent part of a cycle of operation.
Figure 4:
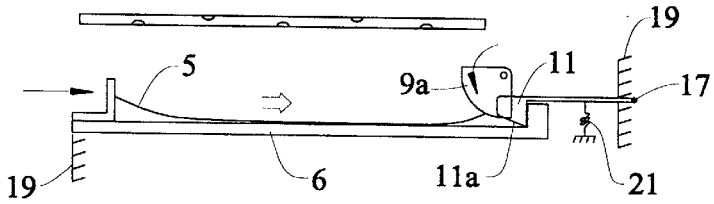
FIG. 4 is similar to FIG. 3 showing the system at a further part of a cycle of operation.

As shown in FIG. 3 guide 9 has rotated so that high section 9*a* is over sheet 5 and moving downward toward it. Pusher 7*a* then moves toward guide 9, thereby engaging the end of sheet 5 and moving it toward guide 9. This action continues, and as high section 9*a* moves closer to table 6 it encounters the end of sheet 5 and begins to press it downward, as shown in FIG. 4.

Figure 5:
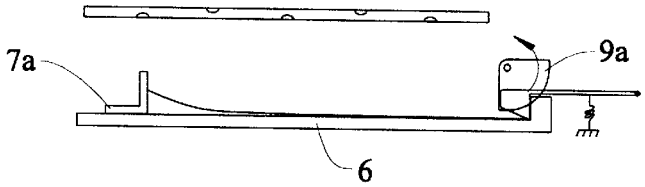
FIG. 5 is similar to FIG. 4 showing the system at a still further part of a cycle of operation.

This action continues until high section 9*a* is at its lowest level and sheet 5 has been moved under clamp arm 11 as shown in FIG. 5. High section 9*a* has overcome any curl in sheet 5 to assure that sheet 5 encounters lower front side 11*a* of clamp arm 11 to be guided under clamp arm 11. Clamp arm 11 is flexed upward under the moving force of sheet 5 to receive sheet 5. Pusher 7*a* continues moving sheet 5 until it is moved in full contact with reference wall 13. Clamp arm 11 is biased downward by resilient member 21, which has a force sufficient to resist curl forces in sheets 5 under clamp arm 11. Sheet 5 is thereby stacked regularly above any previous sheets 5 to which the foregoing operation has been conducted. This is all done under the control of computer C that may use standard electronic control as is now common. When the end of a given set is defined in the software of computer C, computer C causes operation of stapler 15 (FIG. 2) to thereby complete finishing of one job. The stapled set may be removed by hand or mechanically as by grasping mechanically or dropping into a lower bin or pushing forward with a pushing member or members.

It will be apparent that sheet 5 may be moved to reference surface 23 after movement of pusher 7*a*. However, that movement would be against friction from clamp arm 11. Movement against surface 23 and then against surface 13 is therefore preferred.

The system shown would accommodate a finite stack height limited by high section 9*a* of guide 9 no longer being above sheets 5. It will be apparent, however, that guide 9 and clamp arm 11 could be mounted to move upward as a unit so as to move upward an amount corresponding to the height of stacks of sheets 5.

To prevent damaging stops should a hard object be dropped under guide 9, the center of guide 9 from the trailing edge can be eliminated, leaving the same outline as shown in the figures. This renders guide 9 flexible so that it passes over such hard objects. Other variations and modifications are apparent and refinements and improvements employing the essential structures and functioning of this invention can be anticipated.

What is claimed is:

1. Stacking apparatus for sheets which may be curled comprising a support surface upon which individual ones of said sheets may be moved, a first reference surface against which said sheets can be moved across said support surface to be located in a first direction by said first reference surface, a second reference surface against which said sheets can be moved across said support surface to be located in a direction perpendicular to said first direction, an eccentric member having a high section and a low section located over said support surface, said eccentric member being rotatable to locate said high section over sheets being moved across said support surface toward said first reference surface, a clamp member lightly biased toward said support surface having an angled surface to guide a sheet moved across said support surface while said high section holds the sheet downward against curl, movement of said sheet forcing said clamp member open by overcoming said bias, wherein said sheet is clamped by said clamp member, and wherein said eccentric member rotates to present said low section over said support surface when a subsequent sheet drops onto said support surface so several sheets can be stacked on said support surface in a regular stack defined by said first reference surface and said second reference surface.

2. The stacking apparatus as in claim 1 in which said clamp member is an arm pivoted to a frame of said apparatus and bias by a resilient member.

3. The stacking apparatus as in claim 1 in which said angled surface of said clamp member is located facing away from one of said first reference surface and said second reference surface.

4. The stacking apparatus as in claim 2 in which said angled surface of said clamp member is located facing away from said one reference surface.

5. The stacking apparatus as in claim 1 also comprising a stapler or other binding apparatus located to bind said regular stacks while said regular stacks are located by said first reference surface and said second reference surface.

6. The stacking apparatus as in claim 2 also comprising a stapler or other binding apparatus located to bind said regular stacks while said regular stacks are located by said first reference surface and said second reference surface.

7. The stacking apparatus as in claim 3 also comprising a stapler or other binding apparatus located to bind said regular stacks while said regular stacks are located by said first reference surface and said second reference surface.

8. The stacking apparatus as in claim 4 also comprising a stapler or other binding apparatus located to bind said regular stacks while said regular stacks are located by said first reference surface and said second reference surface.

9. The stacking apparatus as in claim 1 also comprising an imaging device having a sheet exit mechanism located to exit sheets over said support surface.

10. The stacking apparatus as in claim 2 also comprising an imaging device having a sheet exit mechanism located to exit sheets over said support surface.

11. The stacking apparatus as in claim 3 also comprising an imaging device having a sheet exit mechanism located to exit sheets over said support surface.

12. The stacking apparatus as in claim 4 also comprising an imaging device having a sheet exit mechanism located to exit sheets over said support surface.

13. The stacking apparatus as in claim 5 also comprising an imaging device having a sheet exit mechanism located to exit sheets over said support surface.

14. The stacking apparatus as in claim 6 also comprising an imaging device having a sheet exit mechanism located to exit sheets over said support surface.

15. The stacking apparatus as in claim 7 also comprising an imaging device having a sheet exit mechanism located to exit sheets over said support surface.

16. The stacking apparatus as in claim 8 also comprising an imaging device having a sheet exit mechanism located to exit sheets over said support surface.

* * * * *